US008221015B2

(12) United States Patent
Gueret

(10) Patent No.: US 8,221,015 B2
(45) Date of Patent: Jul. 17, 2012

(54) PACKAGING AND APPLICATOR DEVICE INCLUDING A WIPER MEMBER

(75) Inventor: Jean-Louis Gueret, Paris (FR)

(73) Assignee: L'Oreal, Paris (FR)

( * ) Notice: Subject to any disclaimer, the term of this patent is extended or adjusted under 35 U.S.C. 154(b) by 924 days.

(21) Appl. No.: 11/922,772

(22) PCT Filed: Jun. 29, 2006

(86) PCT No.: PCT/IB2006/052178

§ 371 (c)(1),
(2), (4) Date: Mar. 7, 2008

(87) PCT Pub. No.: WO2007/004156

PCT Pub. Date: Jan. 11, 2007

(65) Prior Publication Data

US 2009/0028627 A1 Jan. 29, 2009

Related U.S. Application Data

(60) Provisional application No. 60/701,029, filed on Jul. 21, 2005.

(30) Foreign Application Priority Data

Jul. 6, 2005 (FR) ..... 05 52073

(51) Int. Cl.
*A46B 11/00* (2006.01)

(52) U.S. Cl. ..... 401/126; 401/121; 401/122

(58) Field of Classification Search ..... 401/121, 401/122, 126, 128, 129, 130
See application file for complete search history.

(56) References Cited

U.S. PATENT DOCUMENTS

| | | | | |
|---|---|---|---|---|
| 4,433,928 | A | 2/1984 | Kingsford | |
| 4,470,425 | A | 9/1984 | Gueret | |
| 4,628,950 | A | 12/1986 | Bitzer | |
| 5,490,737 | A | 2/1996 | Gueret | |
| 5,803,638 | A | 9/1998 | Gueret | |
| 5,888,005 | A | 3/1999 | Gueret | |
| 6,026,824 | A | 2/2000 | Gueret | |
| 6,033,142 | A | 3/2000 | Gueret | |
| 6,280,112 | B1 * | 8/2001 | Vieu | 401/122 |
| 6,375,374 | B2 | 4/2002 | Gueret | |
| 2003/0196672 | A1 | 10/2003 | Kirita et al. | |
| 2005/0175394 | A1 | 8/2005 | Gueret | |

FOREIGN PATENT DOCUMENTS

| | | | |
|---|---|---|---|
| EP | 0 611 170 | A1 | 8/1994 |
| EP | 0 627 182 | A1 | 12/1994 |
| EP | 0 728 426 | A1 | 8/1996 |
| EP | 1 050 231 | A1 | 11/2000 |
| EP | 1 481 607 | A1 | 12/2004 |
| EP | 1 561 394 | A2 | 8/2005 |
| FR | 2 753 058 | A1 | 3/1998 |
| WO | WO 93/01736 | A1 | 2/1993 |

* cited by examiner

*Primary Examiner* — David Walczak
(74) *Attorney, Agent, or Firm* — Oliff & Berridge, PLC

(57) ABSTRACT

Device for packaging and applying a substance, the device including a receptacle for containing the substance, an applicator member, and a wiper member secured to the receptacle to wipe the applicator member as the applicator member leaves the receptacle. The wiper member includes at least one undulating wiper lip with a radially inner free edge defining the orifice through which the applicator member passes. The undulations of the wiper lip enabling the wiper lip to deploy under thrust from the applicator member.

25 Claims, 5 Drawing Sheets

PACKAGING AND APPLICATOR DEVICE INCLUDING A WIPER MEMBER

The present invention relates to devices for packaging and applying a substance, in particular a cosmetic, e.g. makeup or a care product, the device including an applicator and a wiper member for wiping an applicator member.

Numerous known devices have relatively rigid wiper members that are liable in the long run to damage the applicator member, in particular when the applicator member has bristles or flocking.

European patent application EP-A1-1 050 231 and international application WO 93/01736 describe wiper members having flaps that can be folded to facilitate inserting the applicator member in the receptacle containing the substance.

U.S. Pat. Nos. 6,026,824, 5,888,005, and 4,470,725 disclose wiper members including portions in relief surrounding the orifice of the wiper member.

Patent applications EP-A1-0 627 182, EP-A1-1 481 607, and US 2003/0196672 disclose wiper members having slots that facilitate deformation of the wiper member while the applicator member is being inserted into and/or extracted from the receptacle containing the substance. Such devices can lead to wiping that is not entirely satisfactory.

Patent application FR 2 753 058 discloses a wiper member comprising a sleeve configured to hold a reserve of substance by a surface tension effect. The section of the sleeve is constant over its entire length extending along the longitudinal axis.

U.S. Pat. No. 4,433,928 teaches using an adjustable wiper member, in particular a member that is adjustable to the height of the neck of the receptacle containing the substance for application.

Finally, patent application EP-A1-0 728 426 discloses a wiper member capable of deforming elastically when the applicator member passes therethrough.

There exists a need to further improve devices for packaging and applying a substance, and in particular to benefit from a wiper member capable of wiping a wide variety of applicator members in satisfactory manner, in particular applicator members presenting a cross-section that is relatively large compared with the cross-section of the stem and/or that are relatively fragile, e.g. because they include bristles or flocking.

There also exists a need to leave a more uniform load of substance on applicator members that may present a very wide variety of cross-sections.

There also exists a need for a wiper member that can easily be mounted on the corresponding receptacle.

There also exists a need to avoid the piston effect when the applicator member is taken out from the receptacle.

In one of its aspects, the invention provides a device for packaging and applying a substance, in particular a cosmetic, makeup, or a care product, the device comprising:

a receptacle for containing the substance;

an applicator member; and a wiper member secured to the receptacle to wipe the applicator member as it leaves the receptacle, the wiper member comprising at least one wiper lip having a radially inner free edge defining an orifice through which the applicator member passes, the perimeter of the free edge being strictly greater than the perimeter of the orifice observed in projection from above, e.g. because of the presence of undulations. The perimeter of the free edge may be greater than the perimeter of the stem that is to be wiped, for example.

In one of its aspects, the invention also provides a device for packaging and applying a substance, in particular a cosmetic, makeup, or a care product, the device comprising:

a receptacle for containing the substance;

an applicator member; and a wiper member secured to the receptacle to wipe the applicator member as it leaves the receptacle, the wiper member comprising at least one undulating wiper lip having a radially inner free edge defining an orifice through which the applicator member passes.

The undulations of the wiper lip may enable it to deploy under thrust from the applicator member.

The wiper lip may undulate at least to a non-zero distance from its free edge.

The device may include an applicator comprising a stem with the applicator member being secured to one end thereof.

The presence of undulations may enable the wiper lip to deform more easily as the applicator member passes therethrough while it is being inserted into the receptacle and/or taken out therefrom, but without thereby losing its ability to wipe the applicator member in satisfactory manner, and it can also serve to reduce the piston effect.

The invention also makes it easier to provide a wiper member capable of adapting to an applicator member presenting relatively large amounts of variation in its cross-section, while nevertheless also wiping the stem that supports said applicator member.

By way of example, the applicator member may present a maximum transverse dimension that is greater than the diameter of the portion of the stem that is wiped, when said portion is circular in section.

Depending on the general orientation of the wiper lip relative to the direction in which the applicator member is inserted and taken out, the wiper member may deform more easily, e.g. during insertion or while the wiper member is being taken out.

For example, it is thus possible to arrange the wiper lip in such a manner that it deforms more easily while the applicator member is being returned into the receptacle than while it is being taken out. For example by having a wiper lip that is generally converging towards the bottom of the receptacle, it is possible to obtain relatively thorough wiping of the applicator member on each use, while reducing the risk of damage while the applicator member is being returned into the receptacle.

The wiper member may be more flexible than at least a portion of the applicator member that comes into contact therewith.

At rest, the diameter of the wiper member may be close to that of the stem, and when the applicator member is inserted through the wiper member, the undulations of the wiper lip may deploy, thereby making it easier to enlarge the orifice defined by the wiper lip so as to allow the applicator member to pass through, but without that generating excessive pressure that might cause damage.

The term "undulations" should be understood as designating a sequence of indentations and/or projections formed by the wiper lip when going around its circumference. They may be curved in shape or they may be in the form of folds that are alternately concave and convex on going round the circumference. Each undulation of the wiper lip may extend, when the wiper lip is observed from above, along an axis that is oriented radially. All of the axes of the undulations may intersect substantially at the center of the orifice defined by the wiper lip.

The axes of the undulations may be oriented substantially perpendicular to the longitudinal axis of the device or they may substantially occupy a cone, which cone may converge or diverge towards the bottom of the receptacle.

At least one undulation of the wiper lip may be oriented along a curvilinear or rectilinear line that is not concentric about the longitudinal axis of the device, and in particular that is radial.

The wiper lip need not have any ribs and/or slots, for example slots extending parallel to the longitudinal axis of the device or slots extending perpendicularly to the longitudinal axis of the device, or indeed slots that are inclined relative to the longitudinal axis of the device. In particular, unlike certain prior art wiper members, the wiper member need not have any slots that are substantially closed when at rest and that extend longitudinally.

The undulations of the wiper member may vary in amplitude and in number. The wiper member may, for example, have two to 12 undulations, or four to ten undulations, or indeed five to nine undulations. They may be distributed regularly or irregularly. They may all have the same amplitude, or in a variant they may be of different amplitudes.

Two adjacent undulations may present profiles that are different.

Advantageously, the free edge of the wiper lip, when not under stress, does not extend entirely in one plane.

The wiper lip may occupy a midplane that is substantially perpendicular to the longitudinal axis of the device, or it may generally occupy a cone, either a cone that converges towards the bottom of the receptacle, or a cone that converges towards the outlet from the receptacle.

The thickness of the wiper member may be constant, or in a variant its thickness may vary. For example it may be thinner at points closer to its free edge and thicker at points further away from its free edge.

In the circumferential direction and at a given distance from the longitudinal axis of the device, the wiper member may present a thickness that is substantially constant, e.g. varying by less than 10% on one complete revolution. However its thickness may vary on going towards the longitudinal axis.

The thickness of the wiper lip may lie in the range 0.1 millimeters (mm) to 0.8 mm, for example. More particularly, it may be about 0.2 mm at the free edge and about 0.5 mm at points of the wiper lip that are further from the free edge, e.g. at the periphery of the wiper lip.

The wiper lip may deploy under thrust from the applicator member, possibly prior to stretching in elastic manner. During deployment of the wiper lip, its undulations may tend to flatten out, with the wiper lip being observed from the center of the orifice it defines.

As it deploys, the wiper lip may tend to come closer to a middle surface.

The orifice of the wiper member may be configured to have an aptitude for passing from a small diameter suitable for wiping the stem to a larger diameter enabling the applicator member to be wiped, without necessarily relying on significant elongation of the material constituting the wiper lip.

The orifice of the wiper lip may be circular, or in a variant it may be non-circular, e.g. oval, elliptical, kidney-shaped, or polygonal, e.g. square or rectangular. The shape of the orifice may be selected as a function of the shape of the cross-section of the stem and as a function of the manner in which the applicator is taken out from the receptacle, for example whether it turns about its own axis or not.

The wiper lip may deform more than the applicator member while the applicator member is passing through the orifice.

The total height of the wiper member, measured along the longitudinal axis of the device may be greater than that of the wiper lip and it may remain substantially constant in use, in particular when the applicator member is taken out from the receptacle or is introduced therein.

The wiper lip may press against the stem at least two distinct levels along the longitudinal axis of the device, for example in a manner that is discontinuous in the circumferential direction in the vicinity of the extrema of the undulations.

The cross-section of the stem of the applicator may be substantially constant at least over a major fraction of the length of its portion that comes into contact with the wiper lip while the applicator is being taken out. Under such circumstances, the section of the orifice defined by the wiper lip may correspond substantially to the outside cross-section of said portion of the stem. The stem may present a distal portion that tapers in the proximity of the applicator member, and in particular a distal portion that is conical, which can improve the quality of wiping.

The applicator member may comprise at least one of: a brush with an optionally-twisted core, a comb, a tuft of bristles implanted in the stem to form a paint brush, a spatula, flocking, a foam, and felt.

The applicator member may, for example, comprise a brush which may have any shape that is suitable for the making up that is to be performed. In an embodiment of the invention, the brush presents an envelope surface in the vicinity of its proximal end that has a cross-section that decreases going away from the distal end of the brush. The brush may present an envelope surface of cross-section that goes through a maximum between its two longitudinal ends.

The brush may also present an envelope surface of cross-section that passes through a minimum between its two longitudinal ends.

The brush may be twisted with a left-hand pitch, as described in patent application EP 0 611 170, the content of which is incorporated herein by reference.

A wiper member in accordance with the invention can be used in a variety of packaging devices.

The wiper member may be made out of at least one of the materials in the following list: an optionally vulcanized elastomer, silicone, nitrile rubber, butyl rubber, ethylene propylene terpolymer rubber (EPDM), thermoplastic elastomer, polyester thermoplastic elastomer, styrene isoprene styrene (SIS), SEBS, Hytrel®, Pebax®, polyethylene (PE), polyethylene terephthalate (PET), polyamide (PA), polyvinyl chloride (PVC), and polystyrene (PS).

The wiper member may be mounted on a neck of the receptacle.

The receptacle may include a neck and the wiper member may include an assembly skirt suitable for securing the wiper member in the neck. Where appropriate, the wiper member may include an annular rim that comes to bear against the top surface of the neck of the receptacle.

In a variant, the wiper member may, for example, be overmolded on the receptacle or on a support part, or in a variant it may be secured to the neck of the receptacle by clamping between the receptacle and a support part. The wiper member may, for example, be secured to a ring mounted on the neck of the receptacle.

The device may include means for providing sealing when the receptacle is closed. By way of example, sealing may be provided by the wiper member or by some other part coming to press against the neck of the receptacle.

The wiper member may be mounted in a device having an adjustable wiper member, including a moving portion. Such a configuration can enable the wiper member to be subjected to greater changes in diameter by a displacement of the moving portion.

The receptacle may contain a cosmetic, makeup, or a care product, for example at least one of: a mascara, lipstick, e.g. a liquid lipstick, lip gloss, foundation, nail varnish, eye shadow, eye liner, or blush.

The wiper member may comprise flocking on all or part of its inside surface, and in particular on the wiper lip.

The substance may be for application to keratinous fibers, to the eyelashes, and/or to the eyebrows, to fingernails or toenails, for example, to the skin, to mucous membranes, to the lips, to the eyelids, or to the cheeks.

The present invention also provides a wiper member as such.

The invention can be better understood on reading the following detailed description of non-limiting embodiments thereof, and on examining the accompanying drawings, in which:

FIG. 1 shows a packaging and applicator device 1 comprising a receptacle 2 filled with a substance P containing a cosmetic, makeup, or a care product, e.g. a mascara.

Figure 1:
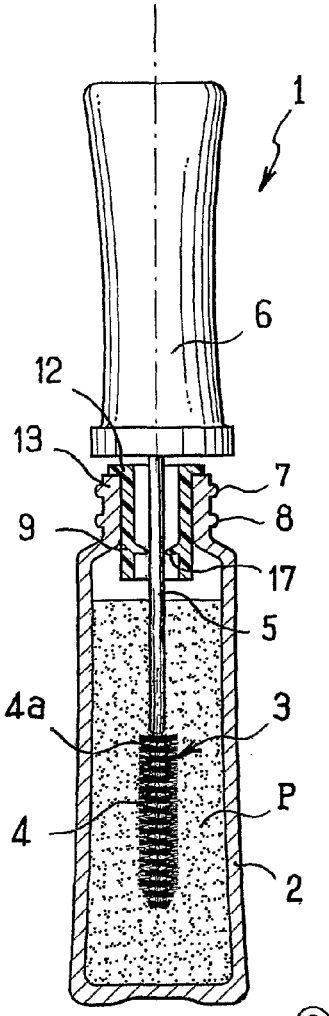
FIG. 1 is a diagrammatic fragmentary axial section view of a packaging and applicator device constituting a first embodiment of the invention.

The device 1 further comprises an applicator 3, itself comprising an applicator member 4 at a first end of a stem 5, the stem being connected at its second end to a closure cap 6 for closing the receptacle 2, being suitable for screw fastening thereto. The stem 5 in the example described is of constant circular section, however the stem of the applicator could present a different section.

In the example shown in FIG. 1, the applicator member 4 is constituted by a brush comprising a metal core twisted to left or to right, with the bristles being clamped between the turns of the core. At its proximal end, the brush 4 may include a chamfer 4*a*. Naturally, it would not go beyond the ambit of the present invention for the brush to have a core that is not twisted or for the applicator to be of some other kind, as described below.

In the example described, the longitudinal axis of the applicator member 4 coincides with the longitudinal axis of the stem 5 and with the axis of the device 1, however the longitudinal axis of the applicator member 4 could be oriented in some other way, e.g. substantially perpendicularly to the longitudinal axis of the stem, e.g. when using a flat stem. The applicator member 4 could also have a longitudinal axis that is not rectilinear. The applicator member 4 may have bristles of different kinds and/or lengths.

Figure 2:
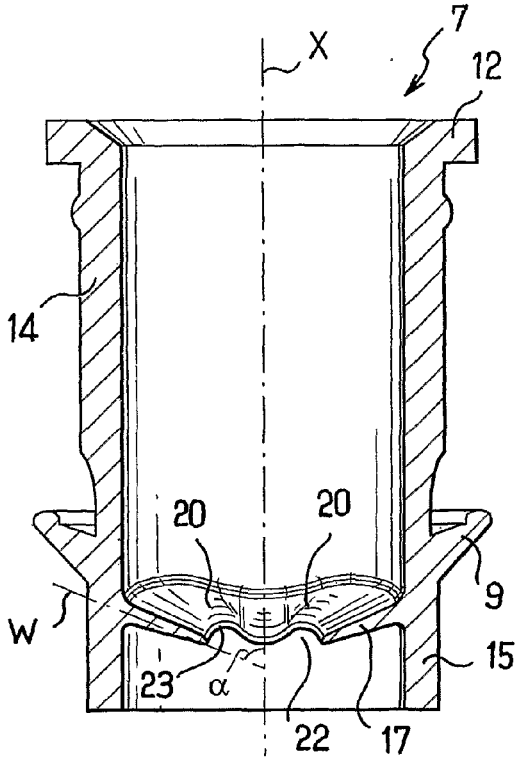
FIG. 2 is a diagrammatic axial section view of the wiper member of the FIG. 1 device shown on its own.
Figure 3:
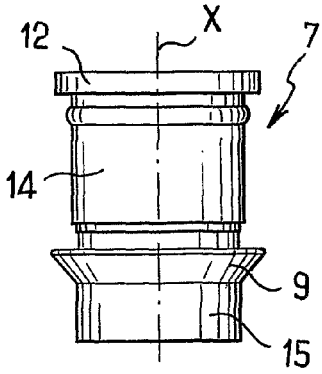
FIG. 3 is an elevation view of the wiper member of the FIG. 1 device shown on its own.

The device 1 includes a wiper member 7 shown on its own in FIGS. 2 and 3, having a longitudinal axis X and secured in the neck 8 of the receptacle 2, e.g. by snap-fastening. For this purpose, the wiper member 7 may include a catch-forming collar 9 that is arranged to snap beneath the neck 8. In a variant that is not shown, the collar 9 is replaced by a shoulder in the outside surface of the wiper member.

The wiper member 7 has an assembly skirt 14 of longitudinal axis X, terminated by a rim 12 that comes to bear against the end face 13 of the neck 8 of the receptacle 2, and that serves advantageously to ensure that the receptacle 2 is sealed when closed by being compressed by the cap 6 when it is fully tightened on the neck 8. Naturally, the cap 6 could be secured onto the receptacle other than by screw fastening, for example it could be secured by snap-fastening or by friction.

In a variant, the wiper member may include an annular rim defining a downwardly open groove in which the top end of the neck 8 engages.

A wiper lip 17 is connected to the bottom surface of a bottom portion of the assembly skirt 14 extending beneath the catch-forming collar 9.

The wiper lip 17 defines internally an orifice 22 through which the applicator member 4 passes on being taken out of the receptacle 2.

In the embodiment of FIGS. 1 to 3, the wiper lip generally occupies a cone that converges towards the bottom of the receptacle, the cone having a generator line W at an angle $\alpha$ relative to the axis X.

Figure 7:
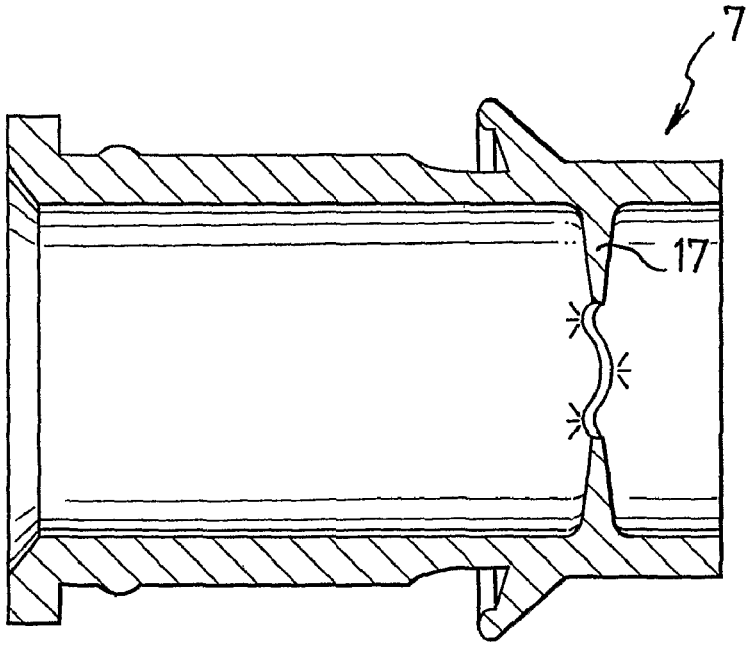
Figure 8:
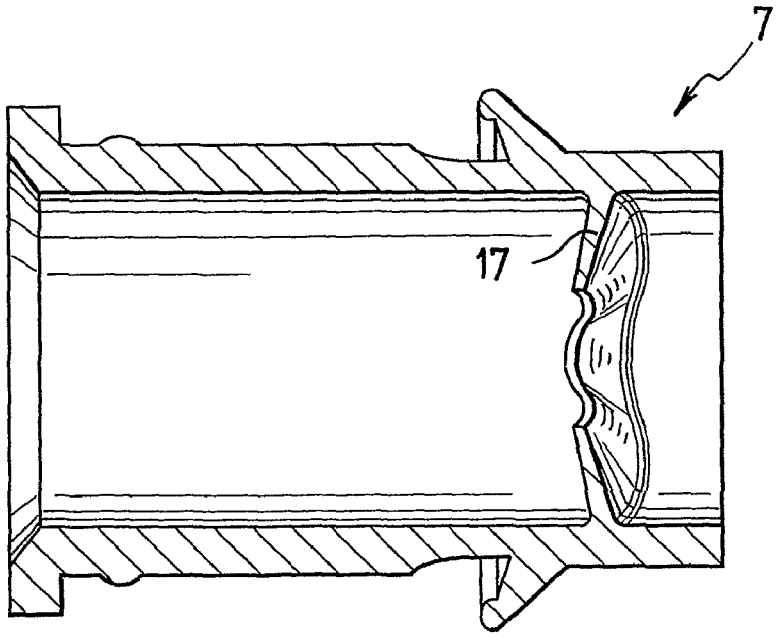

In a variant, and as shown in FIG. 7, the wiper lip 17 could generally occupy a midplane perpendicular to the longitudinal axis of the device. In another variant, as shown in FIG. 8, the wiper lip 17 could generally occupy a cone that converges towards the outlet of the receptacle.

In the example of FIGS. 1 to 3, the thickness of the wiper lip tapers towards the radially inner free edge 23 thereof. The thickness of the wiper lip in the vicinity of its free edge 23 may be about 0.2 mm, for example, while it is about 0.5 mm where the wiper lip 17 joins the assembly skirt 14.

The tapering of the wiper lip 17 towards its free edge 23 can make it easier to deform while the applicator member is being inserted into or taken out from the receptacle 2.

Figure 9:
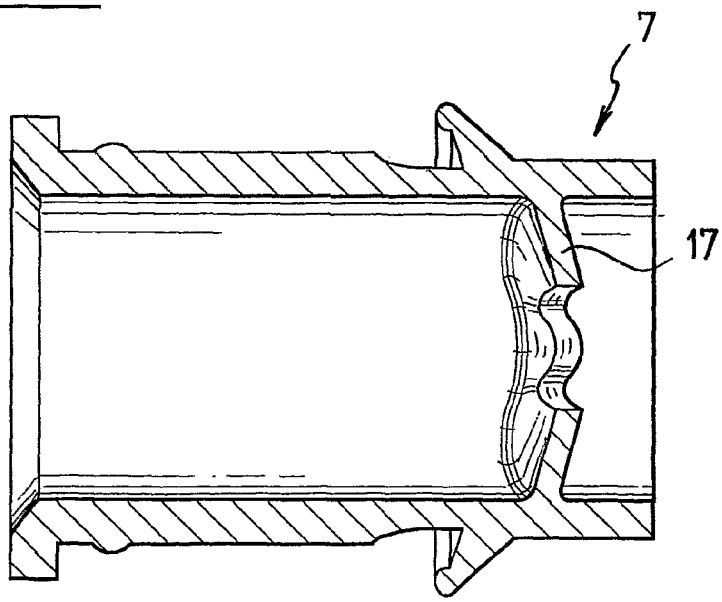
FIGS. 7 to 9 are views analogous to FIG. 2 showing variant embodiments of the invention.

In a variant, the thickness of the wiper lip 17 may be constant, as shown in FIG. 9.

The wiper lip 17 presents undulations 20 extending around the orifice 22.

Figure 4:
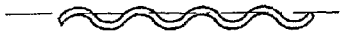
FIG. 4 is a developed view of the wiper lip.

In the example of FIGS. 1 to 3, the wiper lip 17 presents undulations 20 that are all identical, in particular four undulations 20 that are uniformly distributed around the orifice 22, so that two successive undulations are angularly spaced apart by 90°, the undulations being substantially sinusoidal in profile, as shown in the developed view of FIG. 4.

The wiper lip 17 could have some other number of undulations 20, e.g. a number lying in the range three to 12, or in the range four to ten, or indeed five to nine.

Figure 10:
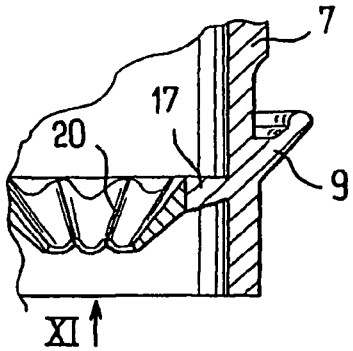
FIG. 10 is a diagrammatic and fragmentary cross-section view of a variant embodiment of a wiper member in accordance with the invention.
Figure 11:
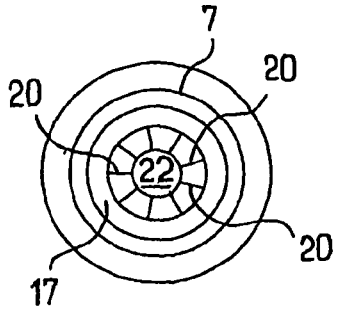
FIG. 11 is a view seen looking along arrow XI of FIG. 10.

FIGS. 10 and 11 show a wiper member 7 having a wiper lip 17 with nine undulations 20 that are uniformly distributed around the orifice 22.

Figure 12:
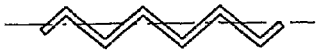
Figure 13:
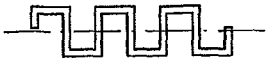

The undulations may form angular folds, as shown in FIG. 12, or crenellations as shown in FIG. 13. The undulations need not be concentric about the longitudinal axis of the applicator.

The undulations may be constituted by a repeating periodic pattern.

It would not go beyond the ambit of the present invention for the undulations to be distributed irregularly. At least one undulation could be different from the others, e.g. in shape or in amplitude.

Figure 14B:
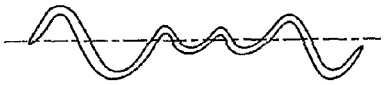
FIGS. 12 to 14B are views analogous to FIG. 4 showing variant embodiments.
Figure 14:
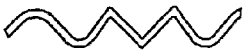

By way of example, FIG. 14 shows an embodiment of a wiper lip that comprises a mixture of curved undulations and angular undulations.

Figure 14A:
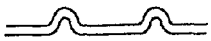

The undulations may extend on either side of a midline, in balanced or in unbalanced manner. In FIG. 14A, it can be seen that the undulations project to one side only of the wiper lip.

The undulations may be of different amplitudes, as shown in FIG. 14B. The undulations may be of an amplitude lying in the range 0.8 mm to 1.2 mm, for example.

The wiper member may be made in at least one of the materials in the following list: optionally vulcanized elastomer, silicone, nitrile rubber, butyl rubber, EPDM, thermoplastic elastomer, SIS, SEBS, Hytrel®, Pebax®, PE, PET, PA, PVC, and PS.

Figure 5:
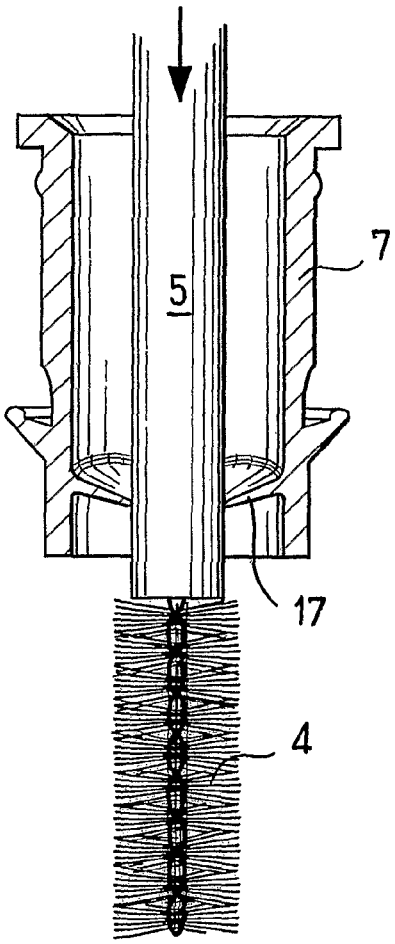
FIGS. 5 and 6 show the use of the FIG. 1 wiper member.
Figure 6:
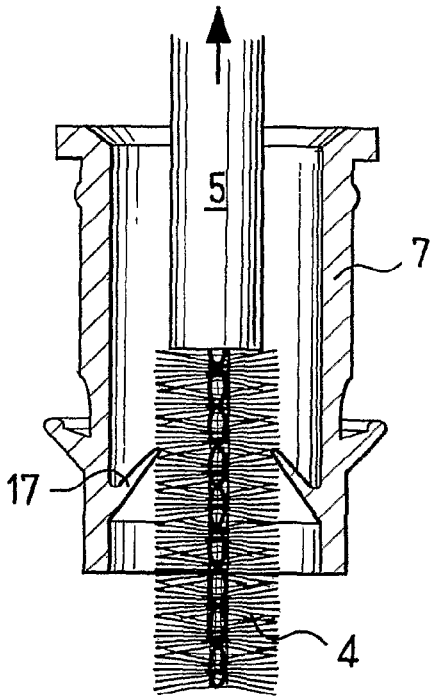

The above-described device is used as follows, as shown in FIGS. 5 and 6.

While the applicator member 4 is being inserted into the receptacle 2, as shown in FIG. 5, or while it is being taken out, as shown in FIG. 6, the undulations 20 are deployed, thereby making it easier for the applicator member to pass through.

The wiper lip 17 may also deform elastically by its material stretching.

Figure 15:
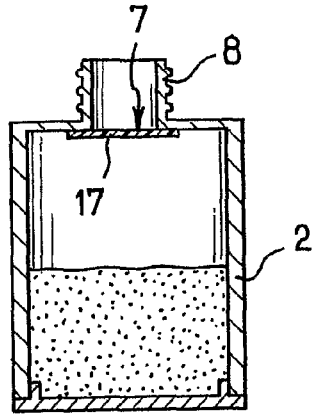

FIG. 15 shows a wiper member 7 having a wiper lip 17 that is overmolded directly onto the neck 8 of the receptacle 2.

The wiper member 7 could also be secured in the neck 8 of the receptacle 2 not by snap-fastening or by overmolding, but by any other means, e.g. by adhesive, heat-sealing, or friction, and it could be made without the catch-forming collar 9.

Figure 16:
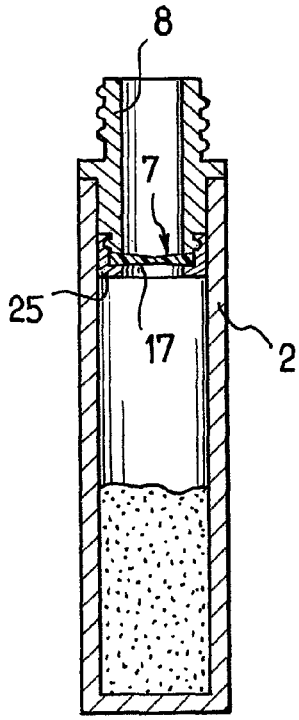

By way of example, FIG. 16 shows a wiper member 7 having a wiper lip 17 secured to a support part 25, itself snap-fastened on a portion forming the neck 8 of the receptacle 2. By way of example, the wiper lip 17 may be overmolded or stuck onto the support part 25 or it may be held by friction between the support part 25 and the neck 8. The support part 25 in the example described is constituted by a ring snapped onto the neck 8, however it would not go beyond the ambit of the present invention for the support part 25 to be secured to the neck 8 by adhesive or by overmolding, for example.

The support part 25 could be made of a material other than that of the neck 8, for example the materials used could present different hardnesses.

In another variant, the device could include means for deforming the wiper member, e.g. for modifying the dimensions of the orifice and/or the range of deformation of the wiper lip as a function of the desired wiping result.

Figure 17:
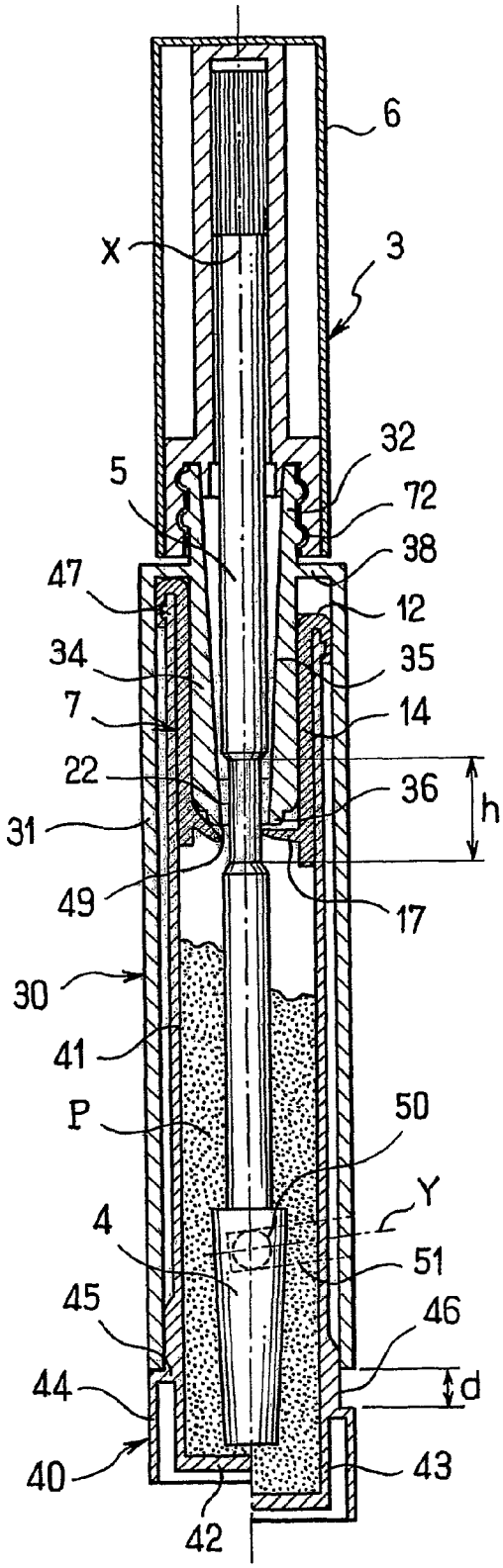
FIGS. 15 to 17 are diagrammatic and fragmentary cross-section views of variant embodiments of devices in accordance with the invention.

For example, FIG. 17 shows a device comprising a first element 30 and a second element 40 that is capable of turning relative to the first element 30 about the longitudinal axis X of the device.

The first element 30 has a generally cylindrical wall 31 of axis X, extended at its top portion by a neck 32 connected at its bottom end to a transverse wall 38. In the example shown the first element 30 also presents an internal extension 34 of tubular shape, defining an insertion cone 35 for the applicator member, that converges towards the inside of the receptacle, and that is provided at its bottom end with an annular bead 36.

In the example described, the second element 40 comprises a generally tubular body 41 about the axis X, that is closed at its bottom end by a bottom wall 42. The bottom portion 43 of the body 41 is surrounded by an outer skirt 44. The top end of the skirt 44 joins the transverse wall 45 which is connected perpendicularly to the body 41. The wall thereof becomes thicker above the transverse wall 45 so as to form a cylindrical guide surface 46 of outside diameter matching the inside diameter of the bottom end of the wall 31. The height of the guide surface 46 is sufficient so that regardless of the angular position of the second element 40 relative to the first element 30, the surface 46 remains substantially in contact with the inside surface of the wall 31.

At its top end, on its radially outside surface, the body 41 presents an annular bead 47 that serves for securing the wiper member 7. The wiper member has an annular rim 12 at its top end arranged to snap-fasten onto the bead 47. The assembly skirt 14 extends in the annular space formed between the inside extension 34 and the top portion of the body 41.

The second element 40 is provided with a stud 50 and the first element 30 includes a slot 51 passing through the wall 31 having a longitudinal axis Y that extends over a portion of a helix, for example, over an annular extent of about 120°, for example, around the axis X. The inclination of the slot 51 makes it possible, for example, to obtain a maximum stroke d in the axial direction lying in the range 2 mm to 3 mm as the stud 50 passes from one extreme position to the other, on the second element 40 turning relative to the first element 30.

When the second element 40 is in its low abutment position with the stud 50 bearing against the left-hand end of the slot 51, the bottom end 49 of the inside extension 34 cannot significantly deform the undulations 20 and the wiper lip 17 of the wiper member 7. Wiping is then at a maximum and the load of substance carried by the applicator member 4 is at a minimum.

When the second element is turned, the stud 50 moves along the slot 51 and rises relative to the first element 30. The inside extension 34 presses downwards against the wiper lip 17 and the undulations 20 are deployed. At the end of the turning stroke, the stud 50 reaches its high abutment position corresponding to the left-hand half section in FIG. 17.

The person skilled in the art can select the degree of deformation of the wiper member as a function of the desired result, e.g. depending on whether or not wiping is to occur regardless of the position of the stud in the slot, or whether it is to be possible in a given position to wipe only against the edge of the inside extension 34.

By way of example, there may be two positions corresponding respectively to wiping against the deformable wiper member 7 and to wiping against the inside extension 34. In a variant, it is also possible to have in at least one position no wiping at all, with the inside extension 34 being made in such a manner that it cannot normally wipe the applicator member.

The wiper member 7 may receive any suitable surface treatment or coating, e.g. flocking.

Figure 18:
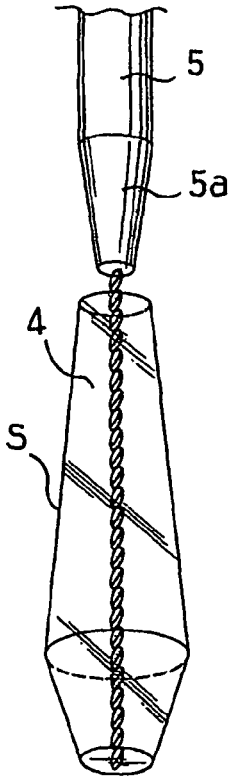
Figure 19:
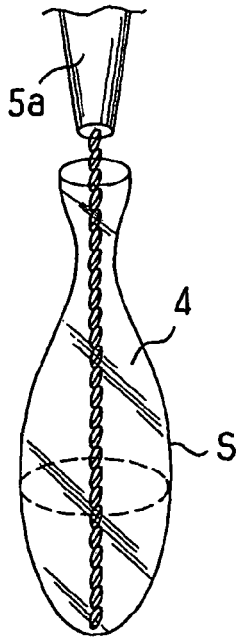

The bristles of the brush 4 in the embodiment of FIG. 1 extend in the example described all around the core, however it would not go beyond the ambit of the present invention for the bristles to occupy a smaller annular sector. The brush may include at least one concave facet or notch.

Where appropriate, the brush may also have an envelope surface S of cross-section that is not constant, e.g. passing through a single maximum as shown in FIG. 18, or through a minimum and a maximum, as shown in FIG. 19.

The brush 4 may in particular be of the kind described in U.S. Pat. No. 5,876,138, with the minimum section being less than the smallest section of the orifice of the wiper member, for example.

FIGS. 18 and 19 show that the stem 5 may have a tapering portion 5*a* at its distal end, e.g. of conical shape. The presence of such a portion 5*a* can contribute to further improving wiping.

In a variant that is not shown, the stem 5 has a narrow portion which occupies a position level with the wiper lip 17 when the receptacle is closed and the applicator is in place. The narrow portion serves to avoid compressing the wiper lip while at rest, and thus serves to reduce any risk of the wiper portion becoming permanently deformed.

Figure 20:
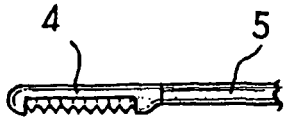
FIGS. 18 to 26 show variant embodiments of the applicator member.
Figure 21:
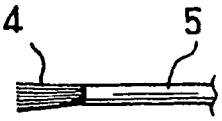
Figure 22:
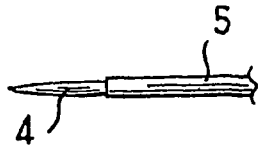
Figure 23:
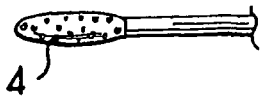
Figure 24:
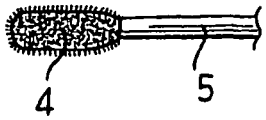
Figure 25:
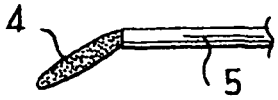

The invention is not limited to one particular type of applicator member, and by way of example the applicator member could be other than a mascara brush, e.g. it could be a comb as shown in FIG. 20, a paint brush as shown in FIG. 21, a pointed felt tip as shown in FIG. 22, a foam as shown in FIG. 23, an optionally flocked endpiece extending along an axis parallel to the longitudinal axis of the stem as shown in FIG. 24, or making an angle relative thereto, as shown in FIG. 25.

The applicator member may have a maximum transverse dimension that is greater than the diameter of the stem 5.

Figure 26:
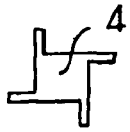

The cross-section of the applicator member may be circular or non-circular. By way of example, FIG. 26 shows an applicator member having cross-section that is substantially square, with elements projecting from its corners.

Naturally, the characteristics of the various embodiments described can be combined with one another in variants that are not shown.

The term "comprising a" should be understood as being synonymous with "comprising at least one" unless specified to the contrary.

The invention claimed is:

1. A device for packaging and applying a substance, the device comprising:

a receptacle for containing the substance;

an applicator member; and a wiper member secured to the receptacle for wiping the applicator member as the applicator member leaves the receptacle, the wiper member having at least one undulating wiper lip having a radially inner free edge presenting a perimeter defining an orifice through which the applicator member passes, undulations of the wiper lip undulating at least to a non-zero distance moving radially away from the perimeter presented by the radially inner free edge, wherein the undulations of the wiper lip enable the wiper lip to deploy under thrust from the applicator member.

2. The device according to claim 1, in which the wiper lip is more flexible than at least a portion of the applicator member that comes into contact therewith.

3. The device according to claim 1, in which the wiper member has 2 to 12 undulations.

4. The device according to claim 1, in which the undulations are distributed irregularly.

5. The device according to claim 1, in which the undulations are distributed regularly.

6. The device according to claim 1, in which the wiper lip generally occupies a midplane perpendicular to a longitudinal axis of the device.

7. The device according to claim 1, in which the wiper lip generally occupies a cone oriented towards the outlet from the receptacle.

8. The device according to claim 1, in which the wiper lip generally occupies a cone oriented towards the bottom of the receptacle.

9. The device according to claim 1, in which the wiper lip is of constant thickness in the circumferential direction at a given distance from the longitudinal axis of the device.

10. The device according to claim 1, in which the wiper lip is of varying thickness, being thinner closer to its free edge.

11. The device according to claim 1, in which the orifice of the wiper lip is circular.

12. The device according to claim 1, in which the wiper member is made of at least one of the materials in the following list: optionally vulcanized elastomer, silicone, nitrile rubber, butyl rubber, EPDM, thermoplastic elastomer, SIS, SEBS, polyester thermoplastic elastomer, PE, PET, PA, PVC, and PS.

13. The device according to claim 1, in which the receptacle comprises a neck and the wiper member includes an assembly skirt serving to secure the wiper member in the neck.

14. The device according to claim 1, in which the wiper member is overmolded on a neck of the receptacle.

15. The device according to claim 1, in which the wiper member is overmolded on a support part.

16. The device according to claim 1, in which the wiper member is secured to the neck of the receptacle by clamping between the receptacle and a support part.

17. The device according to claim 1, in which the wiper member is secured to a ring mounted on a neck of the receptacle.

18. The device according to claim 1, in which the applicator member comprises at least one of: an optionally-twisted brush, a comb, a tuft of bristles, a paint brush, a spatula, flocking, a foam, and felt.

19. The device according to claim 1, in which the receptacle contains at least one of: a cosmetic, make-up or care product, a mascara, lipstick, lip gloss, foundation, nail varnish, eye shadow, eye liner, and blush.

20. The device according to claim 1, comprising an applicator having a stem with the applicator member secured to one end thereof.

21. The device according to claim 1, in which the receptacle closes in leaktight manner.

22. The device according to claim 1, in which the perimeter of the free edge is strictly greater than the perimeter of the orifice when observed in projection from above.

23. The device according to claim 1, in which at least one undulation of the wiper lip extends along a line that is not concentric about the longitudinal axis of the device.

24. The device according to claim 23, wherein all the undulations are not concentric.

25. The device according to claim 1, in which the free edge of the wiper lip does not extend entirely in a plane in the absence of stress.

* * * * *